United States Patent [19]

Imamura et al.

[11] 4,243,559

[45] Jan. 6, 1981

[54] LIQUID DETERGENT COMPOSITIONS CONTAINING ALKANOLAMINES AND POLYOXYALKYLENE ALKYL ETHERS

[75] Inventors: Tetsuya Imamura; Takashi Hiraide, both of Tokyo, Japan

[73] Assignee: Kao Soap Co., Ltd., Tokyo, Japan

[21] Appl. No.: 41,800

[22] Filed: May 23, 1979

[30] Foreign Application Priority Data

Jun. 5, 1978 [JP] Japan ..... 53-67530

[51] Int. Cl.[3] ..... C11D 3/43; C11D 3/30; C11D 3/20

[52] U.S. Cl. ..... 252/548; 252/153; 252/170; 252/DIG. 14

[58] Field of Search ..... 252/153, 548, 170, 89.1, 252/118, DIG. 14

[56] References Cited

U.S. PATENT DOCUMENTS

| | | | |
|---|---|---|---|
| 3,607,764 | 9/1971 | Crotty et al. | 252/139 |
| 3,658,711 | 4/1972 | Mukai et al. | 252/153 X |
| 3,839,234 | 10/1974 | Roscoe | 252/153 X |
| 3,882,038 | 5/1975 | Clayton et al. | 252/153 X |
| 4,060,496 | 11/1977 | Berliner | 252/143 X |

*Primary Examiner*—Harris A. Pitlick

*Attorney, Agent, or Firm*—Blanchard, Flynn, Thiel, Boutell & Tanis

[57] ABSTRACT

A liquid detergent composition comprising 0.5 to 30% by weight of at least one alkanolamine represented by the following general formula (1):

$$(C_nH_{2n}OH)_mNH_{3-m} \quad (1)$$

wherein n is an integer of from 1 to 3 and m is an integer of from 1 to 3, 0.5 to 30% by weight of a polyoxyalkylene mono- or di-lower alkyl ether represented by the following general formula (2):

$$RO(C_2H_4O)_x(C_3H_6O)_yR' \quad (2)$$

wherein R and R′ stand for a hydrogen atom, a methyl group or an ethyl group, with the proviso that the case where both of R and R′ are hydrogen atoms is excluded, the mean value of (x+y) is from 3.0 to 10.0 and the relation of $0.0 \leqq x \leqq 0.25y$ is established, and 0.1 to 20% by weight of at least one surface active agent.

3 Claims, No Drawings

LIQUID DETERGENT COMPOSITIONS CONTAINING ALKANOLAMINES AND POLYOXYALKYLENE ALKYL ETHERS

The present invention relates to a liquid detergent composition. More particularly, the invention relates to a liquid detergent composition which is capable of rapidly and satisfactorily removing oily soils and stains from surfaces in kitchens and equipment associated therewith, such as ventilating fans, particularly oily soils and stains formed by deterioration of oils and the like which have adhered for a long time to the surfaces.

Oily soils and stains originating from foods are often deteriorated by the actions of heat, sun light and oxygen in the ambient air. In many cases, such soils and stains are sticky and resinous or in the form of sticky semi-solids. Such deteriorated oils cannot be rapidly and satisfactorily removed by conventional detergents comprising as main ingredients a surface active agent and a polyphosphate.

It is a primary object of the present invention to provide a liquid detergent composition which is capable of easily removing such deteriorated oily soils and stains and which is free of the objectionable smell of an organic solvent.

In accordance with the present invention, this object can be attained by a liquid detergent composition comprising, as critical active ingredients, (A) a mono-, di- or tri-alkanolamine represented by the following general formula (1):

$$(C_nH_{2n}OH)_mNH_{3-m} \quad (1)$$

wherein n is an integer of from 1 to 3 and m is an integer of from 1 to 3, (B) a polyoxyalkylene mono- or di-lower alkyl ether represented by the following general formula (2):

$$RO(C_2H_4O)_x(C_3H_6O)_yR' \quad (2)$$

wherein R and R' are hydrogen, methyl or ethyl, with the proviso that both of R and R' are not hydrogen simultaneously, the mean value of $(x+y)$ is from 3.0 to 10.0, preferably from 3.5 to 6.0, and the relation of $0.0 \leqq x \leqq 0.25y$ is established, and at least one surface active agent.

The alkanolamine that is used in the present invention saponifies deteriorated oily soils and fats in which many carboxyl groups are present, as a result of oxidative decomposition of oils and fats caused by the strong actions of heat, sun light and oxygen, and thereby remarkably facilitates removal of such oily soils and stains from surfaces.

As other alkaline agents having such a function, there can be mentioned inorganic bases such as caustic soda, sodium silicate and sodium carbonate, and weak acid salts thereof. However, because of their excessively high alkalinity, they are injurious to human skin and they are not suitable as components of household detergents that are likely to contact human skin. Since ammonia has a bad smell, the amount of ammonia used in a cleaning composition should naturally be limited and therefore, a cleaning composition having a sufficient detergent activity cannot be obtained when ammonia is used as an alkaline agent. As another type of alkaline agent, there can be mentioned organic alkaline agents such as amines. These organic alkaline agents, however, cannot be put into practical use because of their characteristic undesirable smell and their relatively high toxicity.

In contrast, the alkanolamines that are used in the present invention have a very low toxicity and they do not produce an undesirable smell. Accordingly, the alkanolamines can be incorporated in the detergent composition in an amount sufficient to attain an excellent cleaning power.

The polyoxyalkylene mono- or di-lower alkyl ether that is used as another critical component in the present invention has the structure represented by the general formula (2). It has a function of swelling and dissolving oily soils and stains. The alkyl ether component is different from other organic solvents capable of dissolving oils and fats because this alkyl ether component has a good smell, is water-soluble and can exert a sufficient swelling and dissolving effect even if it is diluted with water. Solvents customarily used in this field, such as monobutyl and monoisopropyl ethers of ethylene glycol and diethylene glycol, have a characteristic solvent smell, and they are not preferred as components of household liquid detergents. Ethylene glycol monoethyl ether, diethylene glycol monoethyl ether, diethylene glycol monomethyl ether and the like are better, in comparison with these conventional solvents, with respect to their smell, but they are inferior in the basic function of swelling, emulsifying and dissolving oily soils and stains and, therefore, they are not preferred as components of household liquid detergents. In contrast, the polyoxyalkylene mono- or di-lower alkyl ether represented by the general formula (2) has a good smell and has an excellent cleaning power against oily soils and stains, including deteriorated food oils.

The surface active agent that is used in the present invention is not particularly critical. Any of the conventional water-soluble, synthetic, organic surfactants commonly used in conventional household detergent compositions can be used in the present invention.

As such surface active agents, there can be mentioned, for example, anionic surface active agents such as salts of linear or branched long-chain alkyl benzenesulfonates, salts of long-chain monoalkyl sulfates, salts of long-chain alkyl sulfonates, salts of long-chain olefin sulfonates and salts of long-chain alkyl polyoxyethylene (1–6) ether sulfates and alkylphenyl polyoxyethylene (1–6) ether sulfates having 8 to 18 carbon atoms in the alkyl portion, nonionic surface active agents such as long-chain alkyl polyoxyethylene (6–12) ethers, alkylphenyl polyoxyethylene (6–12) ethers having 8 to 18 carbon atoms in the alkyl portion, long-chain fatty acid monoethanolamides and long-chain fatty acid diethanolamides, cationic surface active agents such as long-chain mono- and di-alkyl ammonium salts and long-chain 2-alkyl-2-imidazoline derivatives, and amphoteric surface active agents such as N,N-dimethyl-N-carboxymethyl long-chain alkyl ammonium salts and N,N-dimethyl-N-(3-sulfopropyl) long-chain alkyl ammonium salts.

In the foregoing description, the term "long-chain" means an alkyl chain having 8 to 22 carbon atoms. As the counter ion, there can be mentioned an alkali metal, an alkaline earth metal, ammonium and a lower alkanolamine having 1 to 3 carbon atoms.

The composition of the present invention containing the above-mentioned critical components comprises 0.5 to 30% by weight (all references to "%" given hereinafter means % by weight) of the alkanolamine of the general formula (1), 0.5 to 30% of the polyoxyalkylene mono- or di-lower alkyl ether of the general formula (2) and 0.1 to 20% of the surface active agent.

The composition of the present invention may further contain minor amounts of auxiliary components such as a lower alcohol or a lower alkyl benzenesulfonate salt as a component for maintaining the composition in a stable liquid state at low temperatures, a perfume, a dye and the like.

The balance of the composition is essentially water.

The present invention will now be further described in detail by reference to the following illustrative Examples.

In the Examples, there was treated a thermally deteriorated oily soil prepared by coating a drying oil uniformly on an iron plate and heating the coated iron plate at a high temperature for a certain time to convert the oil to a substantially dry film adhering to the iron plate. This specimen oily soil is representative of oily soil that is formed on a gas range.

There was also treated a sticky resinous substance formed by heating a drying oil at a high temperature for a long time to render the oil viscous, coating a predetermined amount of the viscous oil on an iron plate and exposing the coated iron plate to sun light for several days to polymerize the oil. This specimen oily soil is representative of a resinified oily soil.

The soiled iron plates were washed by scrubbing same with a sponge having a predetermined amount of the detergent composition applied thereto, while applying a certain load on the sponge, by using a reciprocating frictional washing tester. The washing power was evaluated based on the number of frictional rubbing strokes necessary for removing the oil film completely. A smaller value of the scrubbing strokes indicates a higher washing power.

In the Examples, the smell was organoleptically tested by three experts and twenty housewives, and the results were collectively judged according to the following evaluation criteria:

○: good, 3 experts and at least 19 housewives considered that the smell was good Δ: slightly bad, 3 experts and 10 to 18 housewives considered that the smell was good X: bad, all others not included in ○ and Δ

In the Examples, the function of emulsifying and dissolving oils was evaluated in the following manner.

A frying oil was thermally deteriorated at 200° C. for 20 hours in a pan, and 0.1 g of the thus-thermally deteriorated oil was placed in a test tube and 10 ml of a water-soluble solvent was added thereto. The mixture was shaken and the state of emulsification or dissolution was examined. The effect was evaluated according to the following criteria:

○: completely emulsified or dissolved

Δ: a significant amount of nonemulsified or nondissolved portion was observed

X: the oily soil was not significantly emulsified or dissolved

EXAMPLE 1

Various solvents were tested with respect to their smell and their effect of emulsifying and dissolving the thermally deteriorated frying oil. The results shown in Table 1 were obtained.

TABLE 1

| Water-Soluble Solvent | Effect of Emulsifying or Dissolving Thermally Deteriorated Frying Oil | Smell |
|---|---|---|
| Present Invention | | |
| $CH_3O(PO)_{3.0}H$ | ○ | ○ |
| $CH_3O(PO)_{4.0}H$ | ○ | ○ |
| $CH_3O(PO)_{6.0}H$ | ○ | ○ |
| $CH_3O(PO)_{8.0}H$ | ○ | ○ |
| $CH_3O(PO)_{10.0}H$ | ○ | ○ |
| $CH_3O(PO)_{4.0}CH_3$ | ○ | ○ |
| $CH_3O(EO)_{1.0}(PO)_{4.0}H$ | ○ | ○ |
| $C_2H_5O(EO)_{1.0}(PO)_{4.0}H$ | ○ | ○ |
| $CH_3O(EO)_{1.5}(PO)_{7.0}H$ | ○ | ○ |
| Comparison | | |
| $C_2H_5OCH_2CH_2OH$ | Δ | ○ |
| $C_4H_9OCH_2CH_2OH$ | ○ | X |
| $CH_3O(PO)_{2.0}H$ | Δ | Δ |
| $CH_3O(PO)_{15}H$ | ○ | ○ |
| $CH_3O(EO)_{2.5}(PO)_{2.5}H$ | X | ○ |
| $CH_3O(EO)_5(PO)_2H$ | X | ○ |
| $CH_3O(EO)_{1.5}(PO)_4H$ | Δ | ○ |

Note
PO: propylene oxide
EO: ethylene oxide
$CH_3O(PO)_{15}H$ was found to have a good effect of emulsifying or dissolving the thermally deteriorated frying oil, but it was found that this solvent was poor in water-solubility and when it was incorporated into a liquid detergent, a homogeneous transparent composition was not obtained. Thus, it was confirmed that this solvent is not suitable for use as a component of a water-based liquid detergent.

EXAMPLE 2

The properties of various liquid detergent compositions were tested and compared. The results shown in Table 2 were obtained.

TABLE 2

| | Present Invention | | | Comparison Compositions | | | | | | Commercially Available Detergent | | |
|---|---|---|---|---|---|---|---|---|---|---|---|---|
| Composition (% by weight) | | | | | | | | | | | | |
| monoethanolamine | 5 | | | 5 | | | | 0.3 | 5 | | | |
| diethanolamine | | 5 | | | 5 | | | | | | | |
| monoisopropanolamine | | 5 | | | | 5 | | | | | | |
| $CH_3(EO)_{1.0}(PO)_{4.1}H$ | 10 | 10 | | | | | 10 | 10 | 0.3 | | | |
| polyoxyethylene (10 moles) lauryl ether | 2 | 2 | 2 | 2 | 2 | 2 | 2 | 2 | 2 | A | B | C |
| Evaluation | | | | | | | | | | | | |
| number of scrubbing strokes to remove thermally deteriorated oil soils | 10 | 5 | >200 | 15 | 30 | 20 | 120 | 90 | 15 | 165 | 50 | 80 |
| number of scrubbing strokes to remove resinified oil soils | 10 | 5 | >200 | 90 | 100 | 95 | 25 | 25 | 90 | 180 | 150 | 30 |

TABLE 2-continued

| | Present Invention | | Comparison Compositions | | | | | | | | Commercially Available Detergent | |
|---|---|---|---|---|---|---|---|---|---|---|---|---|
| smell | ○ | ○ | ○ | ○ | ○ | ○ | ○ | ○ | ○ | ○ | X | X |

Note
In each composition, water was added so that the total amount was 100% by weight.
Commercially available detergent A: household liquid detergent free of solvent
Commercially available detergent B: household liquid detergent containing ammonia
Commercially available detergent C: household liquid detergent containing ethylene glycol monobutyl ether

EXAMPLE 3

Gas ranges and ventilating fans which were coated with thick films of oily soils and stains were washed by the following liquid detergents.

| | | |
|---|---|---|
| (A) | Monoisopropanolamine | 5% |
| | $CH_3O(PO)_{6.0}H$ | 15% |
| | Polyoxyethylene (9 moles) lauryl ether | 3% |
| | Water | 77% |
| (B) | Diethanolamine | 7% |
| | $CH_3O(EO)_{1.0}(PO)_{6.0}$ | 5% |
| | Sodium polyoxyethylene (1.5 moles) lauryl ether sulfate | 0.5% |
| | Water | 87.5% |
| (C) | Monoethanolamine | 3% |
| | $CH_3O(PO)_{3.0}CH_3$ | 4% |
| | $CH_3O(PO)_{4.5}H$ | 7% |
| | sodium linear dodecyl benzene-sulfonate | 0.5% |
| | Water | 88.5% |
| (D) Commercially available detergent C used in Example 2. | | |

In the detergent compositions (A), (B) and (C), no undesirable smell was observed, and a high washing power was obtained. However, in case of the detergent (D), the washing operation could not be continued for a long time because of a strong solvent smell.

The embodiments of the invention in which an exclusive property or privilege is claimed are defined as follows:

1. A liquid detergent composition consisting essentially of: 0.5 to 30% by weight of one or a mixture of two or more alkanolamines having the formula $$(C_nH_{2n}OH)_mNH_{3-m}$$

wherein n is an integer of from 1 to 3 and m is an integer of from 1 to 3; 0.5 to 30% by weight of one or a mixture of two or more polyoxyalkylene mono- or di-lower alkyl ethers having the formula $$RO(C_2H_4O)_x(C_3H_6O)_yR'$$

wherein R and R' are hydrogen, methyl or ethyl, with the proviso that both of R and R' are not hydrogen simultaneously, the mean value of x plus y is from 3.0 to 10.0 and $0.0 \leqq x \leqq 0.25y$; 0.1 to 20% by weight of one or a mixture of water-soluble, synthetic, organic surfactants; and the balance is essentially water.

2. A liquid detergent composition as set forth in claim 1 wherein the mean value of x plus y is from 3.5 to 6.0.

3. A liquid detergent composition as set forth in claim 1 or claim 2 wherein the surfactant is selected from the group consisting of salts of long-chain alkyl benzenesulfonates having 8 to 22 carbon atoms in the alkyl portion, salts of long-chain monoalkyl sulfates having 8 to 22 carbon atoms in the alkyl portion, salts of long-chain alkyl sulfonates having 8 to 22 carbon atoms in the alkyl portion, salts of long-chain olefin sulfonates having 8 to 22 carbon atoms in the olefin portion, salts of long-chain alkyl polyoxyethylene (1–6) ether sulfates having 8 to 22 carbon atoms in the alkyl portion, salts of long-chain alkyl phenyl polyoxyethylene (1–6) ether sulfates having 8 to 18 carbon atoms in the alkyl portion, long-chain alkyl phenyl polyoxyethylene (6–12) ethers having 8 to 18 carbon atoms in the alkyl portion, long-chain alkyl polyoxyethylene (6–12) ethers having 8 to 22 carbon atoms in the alkyl portion, and mono- and di-ethanolamides of long-chain fatty acids having 8 to 22 carbon atoms.

* * * * *